US009175869B2

(12) United States Patent
Castillo et al.

(10) Patent No.: US 9,175,869 B2
(45) Date of Patent: Nov. 3, 2015

(54) UNIFORM HVAC COMFORT ACROSS MULTIPLE SYSTEMS

(75) Inventors: Daniel Castillo, Plano, TX (US); Sunil Khiani, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 775 days.

(21) Appl. No.: 13/332,870

(22) Filed: Dec. 21, 2011

(65) Prior Publication Data

US 2013/0166075 A1 Jun. 27, 2013

(51) Int. Cl.
*G05D 23/19* (2006.01)
*F24F 11/00* (2006.01)

(52) U.S. Cl.
CPC ..... *F24F 11/0012* (2013.01); *F24F 2011/0046* (2013.01); *F24F 2011/0064* (2013.01); *F24F 2011/0067* (2013.01)

(58) Field of Classification Search
CPC ..... F24F 11/0012; F24F 2011/0046; F24F 2011/0064; F24F 2011/0067
USPC ..... 700/276, 277, 278; 709/230; 370/352, 370/465; 236/51
See application file for complete search history.

(56) References Cited

U.S. PATENT DOCUMENTS 7,133,748 B2 * 11/2006 Robinson ..... 700/276
7,296,426 B2 * 11/2007 Butler et al. ..... 236/1 C
7,349,761 B1 * 3/2008 Cruse ..... 700/276
7,395,137 B2 * 7/2008 Robinson ..... 700/276
7,434,744 B2 * 10/2008 Garozzo et al. ..... 236/51
7,600,694 B2 * 10/2009 Helt et al. ..... 236/91 D
7,702,422 B2 * 4/2010 Grenville Robinson ..... 700/276
7,748,225 B2 * 7/2010 Butler et al. ..... 700/276
7,774,102 B2 * 8/2010 Butler et al. ..... 700/276
7,784,291 B2 * 8/2010 Butler et al. ..... 700/276
7,837,128 B2 * 11/2010 Helt et al. ..... 236/94
8,020,777 B2 * 9/2011 Kates ..... 700/276
8,413,454 B2 * 4/2013 Butler et al. ..... 236/91 F
8,550,368 B2 * 10/2013 Butler et al. ..... 236/1 E
8,695,888 B2 * 4/2014 Kates ..... 236/49.3
2004/0001478 A1 * 1/2004 Wong ..... 370/352
2006/0282195 A1 * 12/2006 Robinson ..... 700/276
2007/0131784 A1 * 6/2007 Garozzo et al. ..... 236/51
2008/0011864 A1 * 1/2008 Tessier et al. ..... 236/51
2008/0048045 A1 * 2/2008 Butler et al. ..... 236/74 R
2008/0066479 A1 * 3/2008 Butler et al. ..... 62/183
2008/0073440 A1 * 3/2008 Butler et al. ..... 236/91 R
2008/0179053 A1 * 7/2008 Kates ..... 165/208
2008/0221738 A1 * 9/2008 Grenville Robinson ..... 700/276
2009/0261174 A1 * 10/2009 Butler et al. ..... 236/51
2010/0168924 A1 * 7/2010 Tessier et al. ..... 700/278
2013/0087628 A1 * 4/2013 Nelson et al. ..... 236/51

* cited by examiner

*Primary Examiner* — Charles Kasenge
(74) *Attorney, Agent, or Firm* — Baker Botts L.L.P.

(57) ABSTRACT

Various embodiments provide an HVAC system that includes first and second controllers. The first controller is configured to control a first demand unit to maintain a setpoint temperature of a first portion of a conditioned space. A second HVAC controller is configured to control a second demand unit to maintain a setpoint temperature of a second portion of the conditioned space. The control provided by the second controller is dependent on a load metric of the first demand unit.

21 Claims, 5 Drawing Sheets

210
220
230
240

UNIFORM HVAC COMFORT ACROSS MULTIPLE SYSTEMS

TECHNICAL FIELD

This application is directed, in general, to heating, ventilating and air conditioning systems and, more specifically, to a methods and systems for controlling such systems.

BACKGROUND

The heating, ventilating and air conditioning (HVAC) requirements of some buildings are provided by multiple HVAC systems. Some such systems service disjoint portions of a conditioned space within the building, and may be essentially independent from each other. Thus, each system may include a controller, an indoor unit (e.g. including a furnace and blower) and an outdoor unit (e.g. including a compressor and fan). Typically, each controller operates to heat or cool its associated space based on a thermal load and a temperature setpoint associated with that space without regard for operation of the other independent HVAC systems.

SUMMARY

One aspect provides an HVAC system that includes first and second HVAC controllers. The first controller is configured to control a first demand unit to maintain a first setpoint temperature of a first portion of a conditioned space. A second HVAC controller is configured to control a second demand unit to maintain a second setpoint temperature of a second portion of the conditioned space. The control of the second setpoint temperature by the second controller is dependent on a load metric of the first demand unit.

Another aspect provides an HVAC system controller. The controller includes a processor configured to execute a control module and a coordination module defined by instructions stored by an associated memory. The control module is configured to control operation of a first demand unit to maintain a first setpoint temperature. The coordination module is configured to modify the operation of the control module based on a load metric of a second demand unit.

Yet another aspect provides a method of manufacturing a heating, ventilation and air conditioning system. The method includes providing first and second HVAC controllers. The first controller is configured to control a first demand unit to maintain a first setpoint temperature of a first portion of a conditioned space. The second controller is configured to control a second demand unit to maintain a second setpoint temperature of a second portion of the conditioned space. The control of the second setpoint temperature provided by the second controller is dependent on a load metric of the first demand unit received from the first controller.

BRIEF DESCRIPTION

Reference is now made to the following descriptions taken in conjunction with the accompanying drawings, in which.

DETAILED DESCRIPTION

Some multi-story homes often suffer from temperature variations on each level. In a typical two-story home with two HVAC systems, one of the systems will consistently run more than the other system due to its location in the home and the season. For instance, during the winter, a downstairs demand unit (e.g. a furnace) may run (e.g. producing heat) significantly longer than the upstairs unit given a same setpoint temperature used for both units. The different run times may result in, e.g. a different humidity on each level and/or real or perceived temperature difference between the two levels. This may cause the homeowner to compromise comfort in certain areas of the home as the local temperature may deviate several degrees warmer or cooler from the setpoint temperature. During the cooling season, a similar effect may result from the unequal cooling load on upstairs and downstairs demand units (e.g. compressors).

Various embodiments of the disclosure reduce such load imbalances, and resulting discomfort, by enabling more uniform temperature and humidity control in structures, e.g. multi-story homes, with more than one HVAC system. Such embodiments may reduce overall energy cost of using HVAC equipment by improving the uniformly of load distribution among HVAC units to more efficiently condition the entire interior space. Such embodiments rebalance the system load and equipment runtimes, which may reduce component failure and increase reliability of the HVAC equipment. Moreover, such embodiments obviate the need for homeowners to manually adjust the load on multiple HVAC systems, in many cases resulting in more consistent load balancing, as well as increased convenience to the homeowner.

Figure 1:
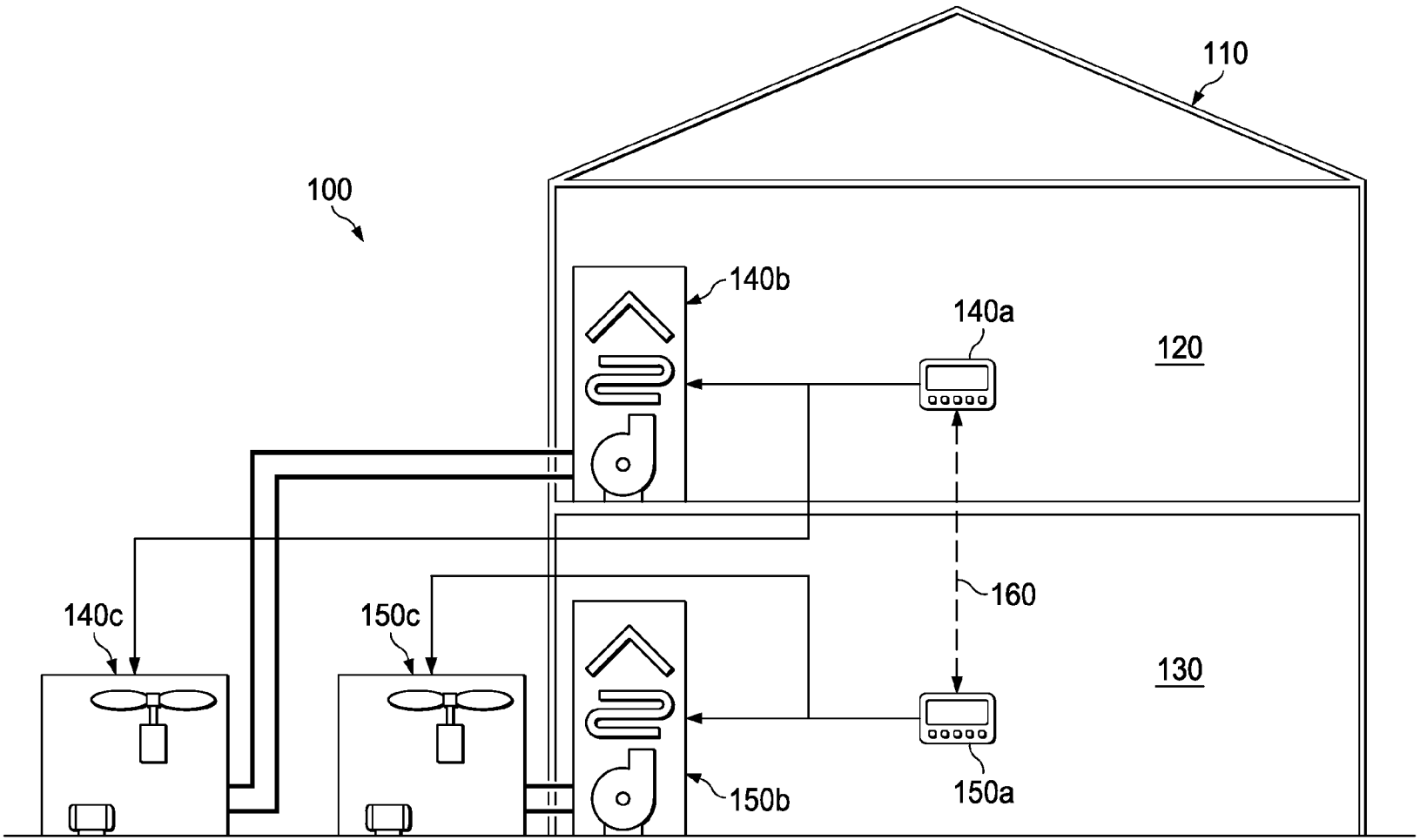
FIG. 1 illustrates a conditioned space, e.g. a house, for which a first HVAC system controlled by a first controller conditions a first space, e.g. the lower floor, and a second HVAC system controlled by a second controller conditions a second disjoint space, e.g. the upper floor.

FIG. 1 illustrates a system 100, e.g. a residential structure 110, or house, including two HVAC systems. The structure 110 includes two levels, or stories, with a total conditioned space associated therewith. A space 120 and a space 130 are respective first and second portions of a total conditioned space, the space 120 being disjoint from the space 130.

A first HVAC system 140 that conditions the space 120 includes a first HVAC controller 140*a*, an indoor demand unit 140*b*, and an outdoor demand unit 140*c*. A second HVAC system 150 that conditions the space 130 includes a second HVAC controller 150*a*, an indoor demand unit 150*b*, and an outdoor demand unit 150*c*. The HVAC controller 140*a* is configured to control the demand units 140*b* and 140*c* to maintain a first setpoint temperature of the space 120. The HVAC controller 150*a* is configured to control the demand units 150*b* and 150*c* to maintain a second setpoint temperature of the space 130. The first and second setpoints may specify the same or different temperatures. As an example and without limitation, one embodiment of the HVAC controllers 140*a* and 150*a* is provided by U.S. patent application Ser. No. 12/603,382 to Grohman, incorporated herein by reference.

In a conventional implementation, the HVAC systems 140 and 150 would operate independently of each other. In this context, "independent" means that the conventional systems operate without regard for the operation of the other system. In other words, each HVAC system 140 and 150, if conventionally configured, would respond to the air temperature measured within the associated conditioned space 120 or 130, and thereby warm or cool the air within the conditioned space. In the conventional case, the HVAC system 140 would, approximately, be unaffected by the heating or cooling load of the space 130. Similarly, the HVAC system 150 would, approximately, be unaffected by the heating or cooling load of the space 120. It is recognized that thermal communication between the spaces 120 and 130 may result in a relatively small flow of heat between the spaces, affecting the operation of the HVAC systems 140 and 150, but such affects are neglected in this discussion for simplicity and clarity.

In embodiments of the disclosure, e.g. the system 100, the HVAC controllers 140*a* and 150*a* communicate via a communications link 160. As described below, the link 160 may be direct, e.g. without involving an intermediate communications entity, or indirect, e.g. involving an intermediate communications entity. One or both of the controllers 140*a* and 150*a* are configured to determine a metric that describes the load experienced by a demand unit controlled by that controller. Thus, for example, the controller 140*a* may determine a first load metric that describes the load on the indoor demand unit 140*b* and/or the outdoor demand unit 140*c*. Similarly, the controller 150*a* may determine a second load metric that describes the load on the indoor demand unit 150*b* and/or the outdoor demand unit 150*c*. The controller 140*a* may communicate the first load metric to the controller 150*a*. The controller 150*a* may compare the first and second load metrics and adjust its operation in accordance. Such adjustment may include, e.g. setting an adjusted setpoint temperature that is higher or lower than a user-specified setpoint temperature entered by the operator into the controller 150*a*. Similarly, the controller 150*a* may communicate the second load metric to the controller 140*a*. The controller 140*a* may compare the first and second load metrics and set an adjusted setpoint temperature that is higher or lower than a user-specified setpoint temperature entered by the operator into the controller 140*a*. By virtue of the adjusted setpoint temperatures, the operation of the HVAC systems 140 and 150 may be more balanced than would otherwise be the case, reducing or overcoming the deficiencies of conventional operation described above.

In various embodiments the controllers 140*a* and 150*a* operate peer-to-peer. Herein and in the claims peer-to-peer operation refers to operation in which each of the controllers 140*a* and 150*a* operates as a master controller of its associated HVAC system, e.g. the systems 140 and 150. As master controllers, the controllers 140*a* and 150*a* do not subordinate their operation to another controller. However, peer-to-peer operation does not preclude the cooperative operation between the controllers 140*a* and 150*a* described herein. In such operation, each controller 140*a* and 150*a* independently operates using input provided by the other controller to make control decisions appropriate to the cooperative relationship.

Figures 2A, 2B:
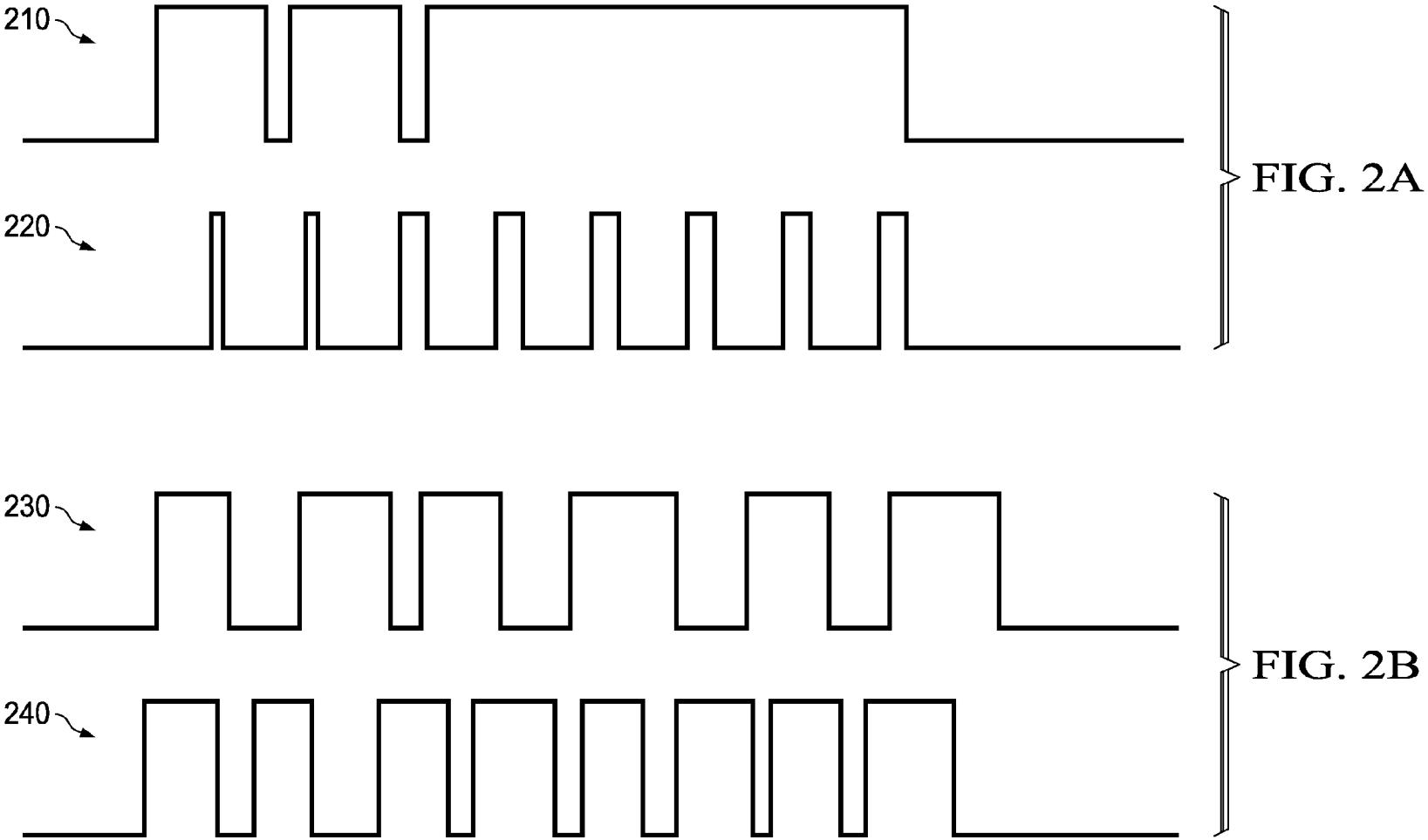
FIG. 2A illustrates duty cycles of a first HVAC system, e.g. the first system of FIG. 1, and a second HVAC system, e.g. the second system of FIG. 1, wherein the first system is excessively loaded compared to the second system.
FIG. 2B illustrates duty cycles of the first HVAC system and the second HVAC system of FIG. 1, wherein the first and second systems are comparably loaded.

FIG. 2A illustrates an example of unbalanced operation of two HVAC systems conditioning a conventionally configured multi-system house. A duty-cycle characteristic 210 illustrates periods of operation (high value) and non-operation (low value) of an HVAC demand unit, e.g. a first compressor. The characteristic 210 may correspond to the operation of a compressor cooling an upper floor in the summer. A duty-cycle characteristic 220 illustrates periods of operation and non-operation of another HVAC demand unit, e.g. a second compressor.

The upper floor of the conventionally configured house typically experiences a greater heat load in the summer than does the lower floor. This effect is typically greater in southern climates than in northern climates. Without any system adjustment to accommodate this thermal load imbalance, the first compressor (characteristic 210) operates with a significantly greater duty cycle than does the second compressor (characteristic 220). As illustrated, the duty cycle of the first compressor may significantly exceed 50%, in which case the first compressor may exceed a specified peak or continuous duty cycle, thereby compromising long-term reliability. Moreover the operation of the first compressor acts to dehumidify the air cooled by the first compressor to a greater degree than does the operation of the second compressor to dehumidify the air cooled by the second compressor.

FIG. 2B illustrates an example of balanced summer operation of two HVAC systems, e.g. the HVAC systems 140 and 150 configured according to embodiments described herein. A duty-cycle characteristic 230 illustrates periods of operation and non-operation of the outdoor demand unit 140*c*. A duty-cycle characteristic 240 illustrates periods of operation and non-operation of the demand unit 150*c*.

The characteristics 230 and 240 indicate the operation of the demand units 140*c* and 150*c* is substantially balanced. Herein and in the claims, balanced operation means the duty cycles of the load units under consideration are comparable. Comparable may mean about equal, as measured by percentage of on time relative to total time. However, strict equality of load is not necessary for operation to be considered comparable. In some cases the duty cycles of two demand units may differ by up to about 50% and still be considered to be comparable. It may be preferable, however, to achieve a smaller duty cycle difference, e.g. no greater than about 20%, to balance wear and tear on the two demand units and/or to achieve comparable perceived comfort in the spaces 120 and 130.

Calculations based on duty cycle may include averaging the duty cycle over a period of time. For example, to avoid spurious control decisions based on instantaneous duty cycle values, a sliding window may be used to compute a time-average of the duty cycle over an operationally meaningful period, e.g. 30 minutes. Such a time window may be any desired value, but in various embodiments advantageously is small enough to provide adequate resolution to respond to changes in thermal load on the structure 110 over the course of a day. Time-average calculations may use historical data of the operation of the controllers 140*a* and 150*a* as described below. The effective duty cycle for variable capacity/multiple staged conditioning systems may take into account the stage and/or capacity at which the unit operates.

Those skilled in the pertinent art will appreciate that the preceding description of duty cycle necessarily includes qualitative aspects, and such a skilled artisan will recognize comparable loading of demand units as exemplified by the characteristics 230 and 240. Moreover, the skilled artisan will further appreciate that the characteristics 230 and 240 are representative of possible duty cycles of an operating demand unit, and that empirically determined duty cycle characteristics may vary significantly from these hypothetical cases and remain within the scope of the disclosure and the claims. Such differences may include, without limitation, distribution of on/off periods, multi-speed operation and variation over the course of a day.

Figure 3A:
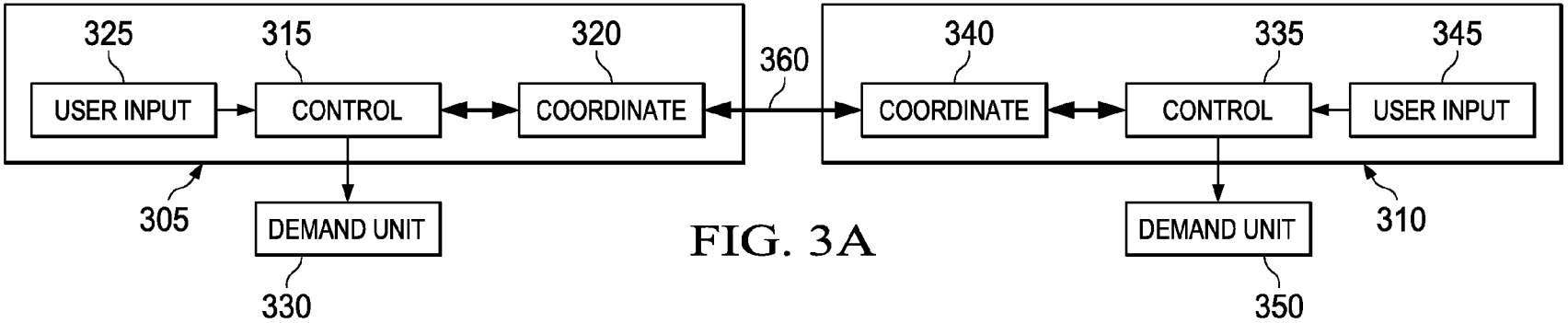
FIG. 3A illustrates first and second HVAC controllers according to one embodiment, e.g. the first and second HVAC controllers of FIG. 1, configured to communicate directly (e.g. wired or wirelessly) to coordinate operation of the first and second HVAC systems to balance loads of first and second HVAC systems.

FIG. 3A illustrates without limitation a functional diagram of an embodiment of HVAC controllers 305 and 310 configured to communicate directly. The controller 305 includes a control module 315 and a coordination module 320. The control module 315 receives a user-specified setpoint via a user input 325 (e.g. a keypad), and controls the operation of a representative demand unit 330. The controller 310 includes a control module 335 and a coordination module 340. The control module 335 receives a user-specified setpoint via user input 345, and controls the operation of a representative demand unit 350. The control modules 315, 335 and coordination modules 320, 340 are described in greater detail below.

The controllers 305 and 310 communicate via a direct connection 360. The connection 360 may be or include, e.g. wires, optical link, or RF link. Communication may be by any conventional or novel protocol. For the purpose of illustration without limitation, the protocol may be one of: any revision level of universal serial bus (USB), IEEE 1394 (Firewire™), Thunderbolt™, RS-232, RS-485, 802.11a/b/g/n, and residential serial bus (RS-Bus). An example of RS-Bus communication protocol is provided, for illustration and without limitation, by U.S. patent application Ser. No. 12/603,526 to Grohman, et al., incorporated herein by reference. The controllers 305 and 310 may exchange via the connection 360 load data, e.g. load metrics, related to the operation of the demand units 330 and 350. As described further below, the controllers 305 and 310 may operate the demand units 330 and 350 to maintain an adjusted setpoint temperature that is different than the setpoint temperature requested via the user inputs 325 and 345.

Figure 3B:
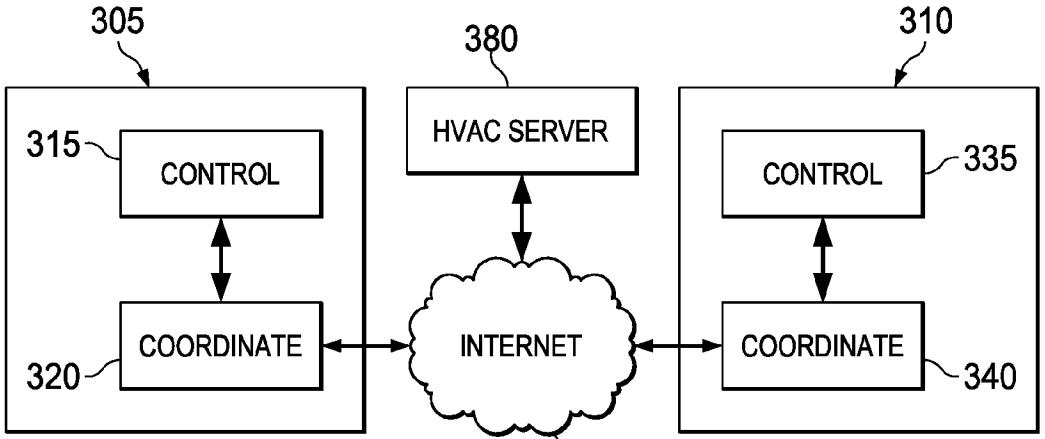
FIG. 3B illustrates the first and second HVAC controllers according to one embodiment, e.g. the first and second controllers of FIG. 1, configured to communicate indirectly (e.g. via the internet, optionally via a server) to coordinate operation of the first and second HVAC systems to balance loads of first and second HVAC systems.

FIG. 3B illustrates without limitation a, functional diagram of an embodiment of HVAC controllers 305 and 310 configured to communicate indirectly. The user inputs 325 and 345 and demand units 330 and 350 are omitted for clarity. As used herein indirect communication between the controllers 305 and 310 involves an intermediate entity. For example, when the communication is via the internet 370 or a local area network (LAN), an intermediate entity may be a router, internet server, etc. The indirect communication may include interaction with an HVAC server 380, in which case the server 380 is the intermediate entity.

The HVAC server 380 may provide services in support of the load balancing function of the controllers 305 and 310. In some embodiments the services are supportive. In such embodiments, the controllers 305 and/or 310 retain primary responsibility for computational and system management functions, while the server 380 may provide support for some computations, provide stored data, configuration tables, meteorological history, etc. In other embodiments the server 380 has primary responsibility for management of the system 100. In such cases, the controllers 305 and 310 may operate as slave devices under the direction of the server 380. The server 380 may perform most or all computations and control operations, and maintain relevant system operating parameters and/or historical data. Such operating parameters may include, e.g. parameters selected to accelerate convergence of the operating states of the controllers 305 and 310 to a desired load balance between the systems 140 and 150. In such embodiments, the controllers 305 and 310 may optionally not communicate directly. Instead any communication between the controllers 305 and 310 may be mediated by the server 380, e.g. in the form of appropriate control commands to one controller that reflect the operational environment or status of the other controller.

Figure 4:
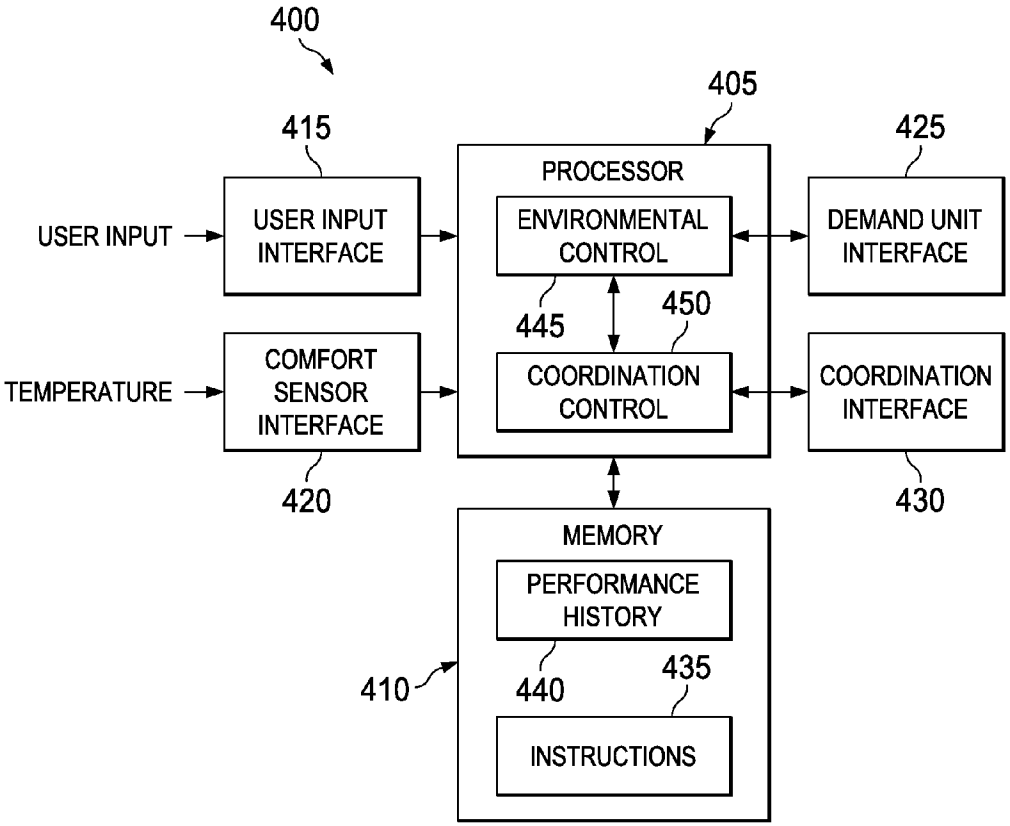
FIG. 4 illustrates a representative schematic view of an HVAC controller, e.g. the first and/or second HVAC controllers of FIG. 1, configured according to various embodiments of the description.

FIG. 4 illustrates a functional block diagram of an HVAC controller 400 that is representative of embodiments of the controllers 140*a*, 150*a*, 305 and 310. The controller 400 includes a processor 405, a memory 410, a user input interface 415, a comfort sensor interface 420, a demand unit interface 425 and a coordination interface 430. Those skilled in the art will appreciate the division of functionality between these modules may be allocated in a different manner than described herein and remain within the scope of the invention.

The comfort sensor interface receives temperature input from a comfort sensor, e.g. a temperature sensor and/or a relative humidity sensor. The user input interface 415 receives input from, e.g. a keypad or touch screen device. The processor 405 may be any type of electronic controller, e.g. a general microprocessor or microcontroller, an ASIC device configured to implement controller functions, a state machine, etc. Similarly the memory 410 may be any type or memory, e.g. static random access memory (SRAM), dynamic random access memory (DRAM), programmable read-only memory (PROM), flash memory and the like. The memory 410 includes instructions 435 and performance history 440. The instructions 435 define the operation of functional modules executed by the processor 405.

An environmental control module 445 provides basic control functions of the system 100, e.g. heating and cooling. The functions provided by the environmental control module 445 may be conventional, but need not be. The environmental control module 445 provides control outputs to the demand unit interface 425 to control demand units such as the indoor demand unit 140*b* and the outdoor demand unit 140*c*. The environmental control module 445 may in some embodiments also receive operational data from the demand unit interface 425 that describes the actual performance of the demand units controlled by the controller 400. Such data may include, e.g. start time, stop time, and power setting, air flow rate (e.g. CFM or CMM), demand %, cooling/heating stage and capacity, and fan speed.

The coordination control module 450 communicates with the coordination interface 430 to implement coordination functions. Such functions may include, e.g. communicating with another HVAC controller directly or via a network. The coordination control module 450 also communicates with the environmental control module 445, for instance to receive a user-specified setpoint temperature and to provide an adjusted setpoint temperature. The coordination control module 450 may also receive from the environmental control module 445 demand unit performance data, from which the module 450 may determine history data. Alternatively, in some embodiments the coordination module 445 indirectly determines history data by recording commands issued from the processor 405 to the demand unit being controlled, e.g. the demand unit 330. History data may include, e.g. date and time tags of the data, the instantaneous duty cycle of the controlled demand unit(s) at a specific time, a time average duty cycle over a time range, time average duty cycles over multiple time ranges, outside air temperature at various times, humidity and season of the year. The history data may be stored in the performance history 440 portion of the memory 410 for later use in load balancing.

The controller 400 may store historical data about any or all equipment operational parameters. For example, control and status messages between the controllers 305 and 310 may be logged, as may communication between the controllers 305, 310 and the server 380. Historical data may be correlated by the controller 400 with actual system 100 performance such that the controller 400 "learns" which control inputs are effective to attain the desired load balance between the HVAC systems 140 and 150 for different indoor and outdoor environmental and setpoint conditions. In some embodiments the aforementioned functions may be provided in part or in whole by the server 380.

Figure 5:
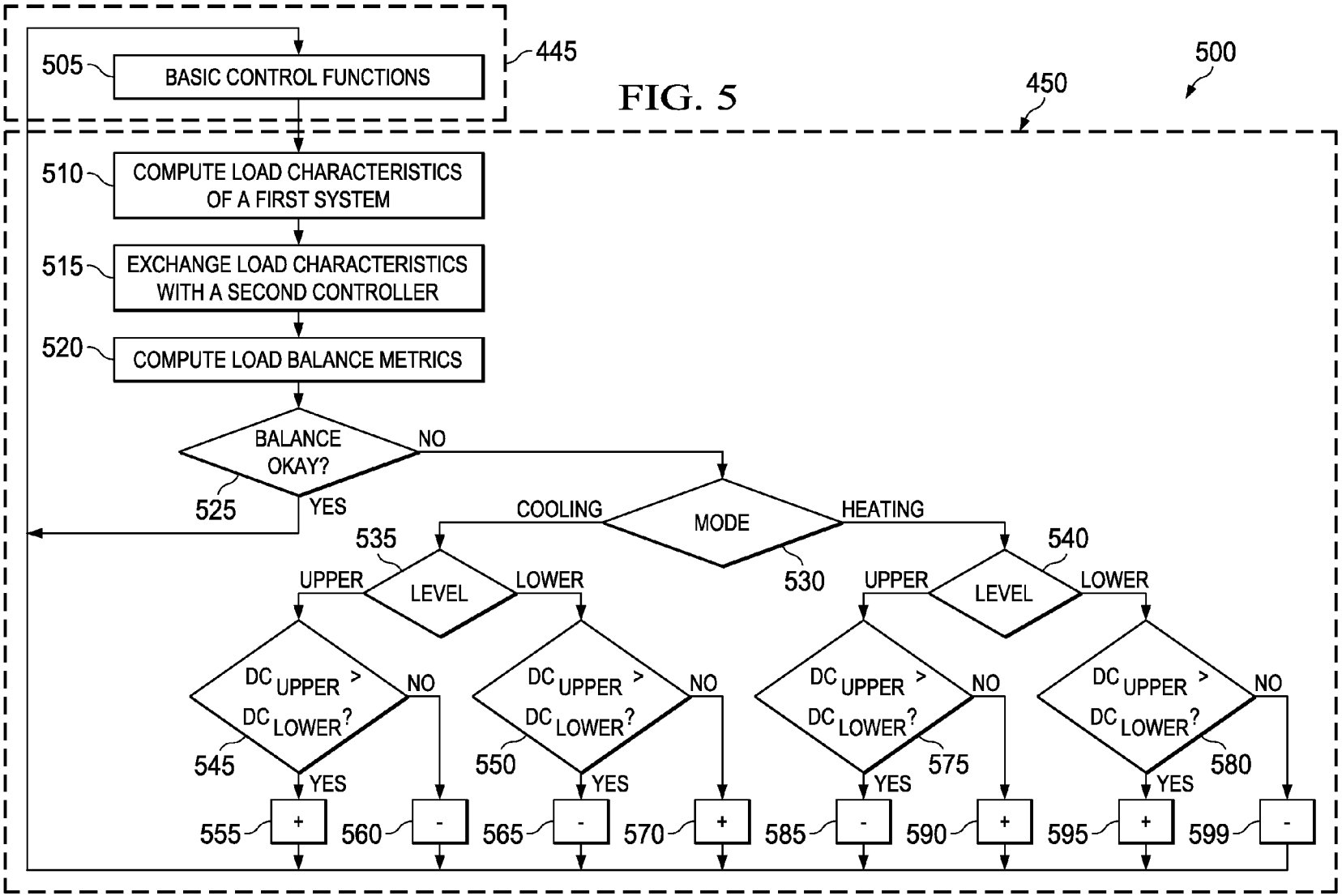
FIG. 5 is a block diagram of a method of controlling a first HVAC system, e.g. the first HVAC system of FIG. 1, wherein a coordination module alters the control provided by a control module based on load metrics of a second HVAC system, e.g. the second HVAC system of FIG. 1.

FIG. 5 illustrates a method 500 that may be implemented by the controller 400 in one embodiment of the invention. The method 500 may be encoded within the instructions 435. Those skilled in the pertinent art will appreciate that the method 500 presents a subset of the steps and branches that a complete control program may include. Extraneous steps and branches are omitted for clarity. Methods within the scope of the disclosure may include any additional steps as needed to implement the described operation of the system 100. Moreover, the method 500 is described with reference to features of the system 100 and/or the controllers 140*a* and 150*a* (e.g. FIG. 1) without limitation thereto. For reference, a portion of the method 500 is referenced to the environmental control module 445, and another portion is referenced to the coordination control module 450.

In some embodiments only one of the controllers 140*a* and 150*a* executes the algorithm 500. In other cases both of the controllers 140*a* and 150*a* execute the method 500 concurrently, e.g. for faster convergence. In yet other embodiments the algorithm is implemented in part or in whole by the server 380, e.g. to relieve the controllers 140*a*, 140*b* of computational burden.

In a step 505 the controller 400 provides basic control functions related to operation of one or more demand units to maintain a temperature setpoint of a conditioned space. The setpoint temperature may be a user-specified setpoint temperature, or an adjusted setpoint temperature as determined by following steps to be described. The control functions may include any conventional and/or novel control algorithm(s) to control the demand units to maintain the setpoint temperature.

In a step 510 the controller 400 computes one or more load characteristics of a demand unit under its control. As described earlier, the load characteristics may include, e.g. a time-average duty cycle or a windowed time-average duty cycle of the demand unit. In a step 515 the controller 400 exchanges load data with another HVAC controller, e.g. as described with respect to the controllers 305 and 310 (FIG. 3). The other HAVC controller may be of any type, but is configured to at least provide load characteristics to the controller 400 that describe the operation of a second demand unit under control by the other controller. In various embodiments the other controller is also operating under control of the method 500. The controller 400 may also provide load characteristics describing the operation of its associated demand unit to the second controller.

In a step 520 the controller 400 computes load balance metrics. Such metrics may include, e.g. a difference of duty cycle of one demand unit, e.g. the demand unit 140*b*, as compared to another demand unit, e.g. the demand unit 150*b*. For example, if the demand unit 140*b* has a duty cycle of 40% and the demand unit 150*b* has a duty cycle of 60%, the duty cycle difference is about 20%. As another example embodiment, such metrics may include a deviation of the calculated duty cycle from a target duty cycle, e.g. 50%. Continuing the previous example, the demand unit 140*b* deviates from 50% by about −10%, and the demand unit 150*b* deviates from 50% by about +10%.

In a decisional step 525 the controller 400 determines if the duty cycle of its associated demand unit is acceptable, e.g. as determined by the load balance metrics computed in the step 520. For example, if the load balance metrics indicate that the demand unit 140*b* is operating outside a preferred duty cycle range, e.g. 50%±10%, the method 500 may branch to a step 530. In another example, if the load balance metrics indicate that the duty cycle of the demand unit 140*b* differs from the duty cycle of the demand unit 150*b* by a degree predetermined to be operationally significant, then the method 500 may also branch to the step 530.

Here, operational significance may be, e.g. a predetermined absolute difference of duty cycle of about 20% or less. Absolute duty cycle difference may be obtained, e.g. by subtracting the duty cycle of one demand unit, e.g. 60%, from the duty cycle of the other demand unit, e.g. 40%, resulting in an absolute difference of 20%. In some cases, it may be desirable to operate the system 100 such that the absolute difference of duty cycles is no greater than about 10% to further reduce the difference of wear and tear on the demand units 140*b* and 150*b*. In some cases, such as when the demand units 140*c* and 150*c* comprise similar or identical components, e.g. compressors of a same model type, it may be desirable to limit the absolute duty cycle difference to no greater than about 10%, e.g. a duty cycle of about 45% for the demand unit 140*c* and a duty cycle of 55% for the demand unit 150*c*.

The difference of duty cycle may be alternatively expressed and controlled in terms of a relative difference of duty cycle. For example, when the duty cycle of the demand unit 140*b* is 60% and the duty cycle of the demand unit 150*b* is 40%, the demand unit 140*b* has a duty cycle that is relatively greater than that of the demand unit 150*b* by 50%. Similarly, an absolute duty cycle difference of about 10% (e.g. 45% and 55% duty cycles) may be expressed as a relative difference of about 22%, and an absolute duty cycle difference of about 5% (e.g. 47.5% and 52.5% duty cycles) may be expressed as a relative difference of about 10%.

The controller 400 may also utilize the performance history 440 in determining if the load balance is acceptable. For example, instantaneous or short-period excursions of the duty cycles may be acceptable when the time-average duty cycle difference remains below a desired threshold value. Furthermore, when operating objectives include approximate equalization of wear and tear on the demand units 140*b* and 150*b*, the controller 400 may determine from the performance history 440 a total operational time of the demand units 140*b* and 150*b*. The controller 400 may then include calculation of operating load of the demand units 140*b* and 150*b* in determining an acceptable balance. Such a calculation may include, e.g. determining a load metric that takes into account operation at a high RPM for a high load and low RPM for a low load, compressor runtimes and heating (gas and/or electric) runtimes.

If by the selected criterion the load balance between the relevant demand units is acceptable, the method 500 returns from the step 525 to the step 505 to continue controlling the demand units according to the current setpoint temperatures. If the load balance is not acceptable, then the method 500 branches to the step 530.

In the step 530, the method branches to a decisional step 535 if the system 100 is operating in a cooling mode. In the step 535, the controller 400 determines if it is controlling the temperature of an upper floor of the conditioned space, e.g. the space 120, or controlling the temperature of a lower floor, e.g. the space 130. Such may be set, e.g. via a switch configured by an installer. If the controller 400 is controlling an upper floor, the method 500 continues to a step 540, and the controller identifies as the controller 140*a*. If in the step 540 the duty cycle of the demand unit 140*c* is greater than that of the demand unit 150*c*, the method 500 branches to a step 545 and increases the setpoint temperature of the controller 140*a*, thereby incrementally reducing the duty cycle of the demand unit 140*c*. If instead in the step 540 the duty cycle of the demand unit 140*c* is less than the duty cycle of the demand unit 150*c*, the method branches to a step 550 and incrementally decreases the setpoint temperature, thereby increasing the duty cycle of the duty cycle of the demand unit 140*c*.

If in the step 535 the controller 400 determines it is operating in the lower level of the structure 110, the controller identifies as the controller 150*a*. In a step 555 the controller 150*a* determines if the duty cycle of the demand unit 140*c* is greater than the duty cycle of the demand unit 150*c*. If so, the method 500 continues to a step 560 and the controller 150*a* decreases its setpoint temperature, thereby incrementally increasing the duty cycle of the demand unit 150*c*. If instead the duty cycle of the demand unit 150*c* is less than the duty cycle of the demand unit 140*c* the method 500 branches to a step 565 wherein the controller 150*a* increases its setpoint temperature, thereby incrementally decreasing the duty cycle of the demand unit 150*c*.

If in the step 530 the system 100 is operating in a heating mode, then the method branches to a step 570. In the step 570 the controller 400 determines if it is operating in an upper or lower level of the structure 110. If operating in the upper level, the controller identifies as the controller 140*a* and the method advances to a step 575. In the step 575 the controller 140*a* determines if the duty cycle of the demand unit 140*b* is greater than that of the demand unit 150*b*. If so, the method 500 branches to a step 580 wherein the controller 140*a* reduces its setpoint temperature, thereby reducing the duty cycle of the demand unit 140*b*. If instead the duty cycle of the demand unit 140*b* is less than that of the demand unit 150*b*, the method 500 branches from the step 575 to a step 585 wherein the controller 140*a* increases its setpoint temperature, thereby increasing the duty cycle of the demand unit 140*b*.

If in the step 570 the controller 400 determines it is operating in the lower level of the structure 110, the controller identifies as the controller 150*a*. The method then branches to a step 590. In the step 590 the controller 150*a* determines if the duty cycle of the demand unit 140*b* is greater than that of the demand unit 150*b*. If so, the method 500 branches to a step 595 wherein the controller 150*a* increases its setpoint temperature, thereby increasing the duty cycle of the demand unit 150*b*. If instead the duty cycle of the demand unit 140*b* is less than that of the demand unit 150*b*, the method 500 branches from the step 590 to a step 599 wherein the controller 150*a* decreases its setpoint temperature, thereby decreasing the duty cycle of the demand unit 150*b*. In some embodiments (not shown) a demand unit of the HVAC system under control by the method 500 (e.g. the HVAC system 140) may increase the stage of that system based on demand %, in addition to duty cycle. Such embodiments may be applicable to, e.g. a variable capacity cooling and heating system.

After each of the steps 545, 550, 560, 565, 580, 585, 595 and 599 the method returns to the step 505 to resume control of the applicable demand units using the adjusted setpoint temperature as the current control setpoint.

In each of the above steps wherein the setpoint temperature is adjusted, the temperature increment or decrement may be fixed amount, e.g. 1° F. (~0.5° C.) or may be an amount related to the absolute duty cycle difference as discussed above. For example, when controlling for an absolute duty cycle difference of 5%, the temperature increment may be about 2° F. when the instantaneous absolute duty cycle difference is about 20%, but the temperature increment may be about 1° F. when the instantaneous absolute duty cycle difference is about 10%. After determining and storing the adjusted setpoint temperature the method 500 returns to the step 505.

When performing the method 500, the controllers 140*a* and 150*a* may optionally continue to display the user-specified setpoint temperature on a display while controlling the associated demand unit(s) for the adjusted setpoint temperature. Thus the user may be insulated from the possibly confusing setpoint changes implemented by the controllers 140*a* and 150*a* to balance the loads of the demand units. If the user perceives discomfort while located in the upper level space 120 or the lower level space 130, the user may enter a new user-specified setpoint temperature. The controllers 140*a* and 150*a* may then continue to operate the method 500 to balance the duty cycles of the demand units while attaining an overall compromise of adjusted setpoint temperatures to achieve overall comfort within the structure 110. In various embodiments the algorithm may limit the adjustment of setpoint to a small temperature range, e.g. about ±4° F. (~2° C.), to make duty cycle adjustments within the range of user's desired comfort. In some embodiments this setpoint limit is a configurable parameter, e.g. by the user, installer or manufacturer.

Figure 6:
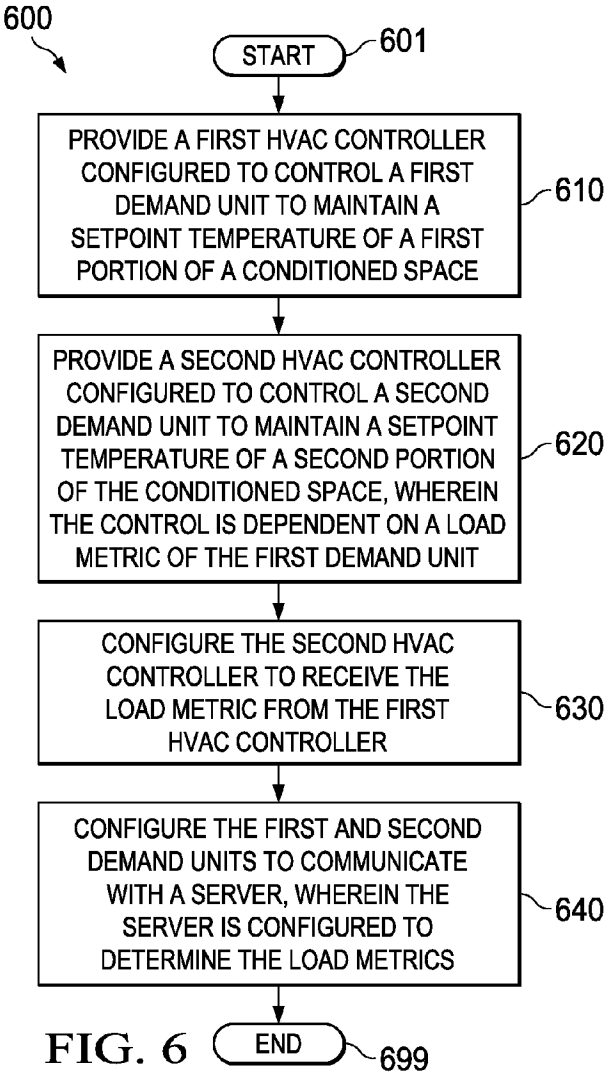
FIG. 6 is a method of the disclosure, e.g. a method of manufacturing an HVAC system, e.g. the HVAC system of FIG. 1.

Referring now to FIG. 6, a method 600, e.g. of manufacturing an HVAC system, is presented. The method 600 is described without limitation with reference to the previously described features, e.g. in FIGS. 1-5. The steps of the method 600 are presented in a nonlimiting order, may be performed in another order or in some cases omitted.

In a step 610, a first HVAC controller, e.g. the controller 140*a*, is provided. Herein and in the claims, "provided" means that a device, substrate, structural element, etc., e.g. the controller 140*a*, may be manufactured by the individual or business entity performing the disclosed methods, or obtained thereby from a source other than the individual or entity, including another individual or business entity. The first controller is configured to control a first demand unit, e.g. the indoor demand unit 140*b*, to maintain a setpoint temperature of a first portion of a conditioned space, e.g. the space 120.

In a step 620, a second HVAC controller, e.g. the controller 150*a*, is provided. The second controller is configured to control a second demand unit, e.g. the demand unit 150*b*, to maintain a setpoint temperature of a second portion of the conditioned space, e.g. the space 130. The control exercised the second control unit is dependent on a load metric of the first demand unit, such as one of the load metrics described previously.

In a step 630 the second HVAC controller is configured to receive the load metric from the first HVAC controller, e.g. by a direct or indirect connection.

In a step 640 the first and second HVAC controllers are configured to communicate with a server, e.g. the HVAC server 380, wherein the server is configured to determine the load metrics.

In any of the above embodiments of the method 600, first and second controllers may be configured to directly communicate to exchange load metrics of the first and second demand units.

In any of the above embodiments of the method 600, the control provided by the first controller may be dependent on a load metric of the second demand unit.

In any of the above embodiments of the method 600, the first and second controllers may operate peer-to-peer.

In any of the above embodiments of the method 600, the first and second controllers may communicate via a residential serial bus.

In any of the above embodiments of the method 600, the first and second controllers may communicate wirelessly.

Those skilled in the art to which this application relates will appreciate that other and further additions, deletions, substitutions and modifications may be made to the described embodiments.

What is claimed is:

1. A heating, ventilation and air conditioning (HVAC) system, comprising:

a first HVAC controller configured to control a first demand unit to maintain a setpoint temperature of a first portion of a conditioned space; and a second HVAC controller configured to control a second demand unit to maintain a setpoint temperature of a second portion of said conditioned space;

wherein said first HVAC controller is configured to:

determine a difference between a duty cycle of the first demand unit and a duty cycle of the second demand unit, the difference determined based on load metrics of said first and second demand units; and adjust the setpoint temperature of the first portion of the conditioned space such that operating the first demand unit to maintain the adjusted setpoint temperature reduces the difference between the duty cycle of the first demand unit and the duty cycle of the second demand unit.

2. The HVAC system of claim 1, wherein said first and second controllers are configured to directly communicate to exchange load metrics of said first and second demand units.

3. The HVAC system of claim 1, further comprising a server in communication with said first and second demand units, said server being configured to determine said load metrics.

4. The HVAC system of claim 1, wherein said control provided by said first controller is dependent on a load metric of said second demand unit.

5. The HVAC system of claim 1, wherein said first and second controllers operate peer-to-peer.

6. The HVAC system of claim 1, wherein said first and second controllers communicate via a residential serial bus.

7. The HVAC system of claim 1, wherein said first and/or second controllers are configured to display a temperature that is different from said setpoint temperature.

8. A heating, ventilation and air conditioning system controller, comprising:

a processor;

a memory containing operating instructions for said processor;

a control module of said instructions configured to control operation of a first demand unit; and a coordination module of said instructions configured to:

modify said control operation based on a load metric of a second demand unit, the load metric of the second demand unit comprising an indication of a duty cycle of the second demand unit;

determine, using the load metric of the second demand unit, a difference between a duty cycle of the first demand unit and the duty cycle of the second demand unit; and adjust a setpoint temperature such that operating the first demand unit to maintain the setpoint temperature reduces the difference between the duty cycle of the first demand unit and the duty cycle of the second demand unit.

9. The controller of claim 8, wherein said processor is configured to communicate directly with a second processor to obtain said load metric.

10. The controller of claim 8, wherein said processor is configured to communicate with a server to obtain said load metric.

11. The controller of claim 8, wherein said processor is configured to provide a load metric of said first demand unit to a second processor.

12. The controller of claim 8, wherein said processor is configured to obtain said load metric via a residential serial bus.

13. The controller of claim 8, wherein said controller is configured to obtain said load metric wirelessly.

14. A method of manufacturing a heating, ventilation and air conditioning (HVAC) system, comprising:

providing a first HVAC controller configured to control a first demand unit to maintain a setpoint temperature of a first portion of a conditioned space; and providing a second HVAC controller configured to control a second demand unit to maintain a setpoint temperature of a second portion of said conditioned space;

wherein said first HVAC controller is configured to:

determine a difference between a duty cycle of the first demand unit and a duty cycle of the second demand unit, the difference determined based on load metrics of said first and second demand units; and adjust the setpoint temperature of the first portion of the conditioned space such that operating the first demand unit to maintain the adjusted setpoint temperature reduces the difference between the duty cycle of the first demand unit and the duty cycle of the second demand unit.

15. The method of claim 14, further comprising configuring said second HVAC controller to receive said load metric from said first HVAC controller.

16. The method of claim 14, further comprising configuring said first and second demand units to communicate with a server, said server being configured to determine said load metrics.

17. The method of claim 14 wherein said first and second controllers are configured to directly communicate to exchange load metrics of said first and second demand units.

18. The method of claim 14, wherein said control provided by said first controller is dependent on a load metric of said second demand unit.

19. The method of claim 14, wherein said first and second controllers operate peer-to-peer.

20. The method of claim 14, wherein said first and/or second controllers are configured to display a temperature that is different from said setpoint temperature.

21. The method of claim 14, wherein said first and second controllers communicate wirelessly.

* * * * *